United States Patent [19]

Harrison

[11] Patent Number: 4,760,681

[45] Date of Patent: Aug. 2, 1988

[54] BACK-SPLASH MOLDING

[75] Inventor: Walter L. Harrison, Eastlake, Ohio

[73] Assignee: K B & H, Inc., Cleveland, Ohio

[21] Appl. No.: 896,593

[22] Filed: Aug. 13, 1986

[51] Int. Cl.[4] ..... E04F 19/04

[52] U.S. Cl. ..... 52/716; 52/98; 52/288

[58] Field of Search ..... 52/716, 288, 98, 470

[56] References Cited

U.S. PATENT DOCUMENTS

| | | | |
|---|---|---|---|
| 3,271,232 | 9/1966 | Moore | 52/288 X |
| 4,150,517 | 4/1979 | Warner | 52/288 |
| 4,289,818 | 9/1981 | Casamayor | 52/98 X |
| 4,601,149 | 7/1986 | Dokan | 52/716 X |

FOREIGN PATENT DOCUMENTS

| | | | |
|---|---|---|---|
| 1372447 | 6/1964 | France | 52/716 |
| 814655 | 6/1959 | United Kingdom | 52/716 |

*Primary Examiner*—J. Karl Bell

*Attorney, Agent, or Firm*—James H. Tilberry

[57] ABSTRACT

A deformable molding is provided to form watertight sealing between formica covered panel members such as back-splash boards and countertops. The molding includes a first part to fit between first and second panel members and to be secured thereto by pressure-sensitive adhesive means. The molding also includes a pair of lip portions adapted to be biased into pressure sealing contact with respective adjacent panel members.

4 Claims, 3 Drawing Sheets

BACK-SPLASH MOLDING

BACKGROUND OF THE INVENTION

This invention relates to molding as used in the cabinet art, and in particular to the art of molding for kitchen and bathroom splash boards, although it has application to any cabinet, wall joint or the like in which a watertight seal is desirable.

The most widely used molding on countertops and other similar applications at the present time is the chromium-plated sheet metal molding which comes in several shapes. In one embodiment as shown in FIG. 1, the L-shaped molding is nailed to the back edge of a countertop and a front lip extends upwardly against the front face of the back-splash board. In another embodiment as shown in FIG. 2, the U-shaped molding is snap-fit over the bottom edge of the back-splash board, after this molding has been nailed to the back-splash board supporting wall. There are several disadvantages to this type of molding, including the fact that it generally only comes in 12-foot lengths, requiring that it be cut and mitered on the job or custom-fit at the factory. In addition, sheet metal molding is too rigid to fully conform to imperfections in the countertop contour, thereby requiring caulking in the gaps which the molding does not fill between the countertop and the back-splash board. Once the molding has been caulked, it is thereafter a continuous maintenance problem because the caulking continues to bleed out from between the back-splash board and the countertop as water contacts the caulking during wiping and cleaning of the countertop.

Additionally, this type of molding is only available in chrome finish, which is not always compatible with the decorating scheme of the particular installation. Furthermore, the caulking is not an inconsiderable item of expense in installing this molding, since most countertop installations require at least 1½ tubes of caulking.

SUMMARY OF THE INVENTION

The subject invention has been developed to overcome the shortcomings of prior art sheet metal molding, including the provision of molding which is cheaper and easier to install and which provides a much more sanitary bond between the back-splash board and the countertop.

In a preferred embodiment, the subject molding is a polyvinyl chloride extrusion, having a generally rectangular cross section. Since the product is extruded, it may be of any length. However, for convenience of packaging, storage, transporation, and use, rolls of 25 feet, or multiples thereof, are recommended for commercial application. Polystyrene foam tape with both surfaces of the tape impregnated with pressure-sensitive adhesive is secured to both the upper and lower faces of the rectangular extrusion. By suitable means, such as the use of polyvinyl strip material, the outer surfaces of the tape are protected until the molding is to be installed. At the time of installation, the polyvinyl material is stripped from the surface of the top side of the tape and positioned on the under side of the bottom edge of the back-splash. The polyvinyl material is then stripped from the under side of the tape and the back-splash is then pressed into place on the countertop. Integrally extruded with the rectangular portion of the molding is a sealing cap comprising an upper lip extending along the upper edge of the extruded, rectangular portion, and a lower lip extending along the lower edge of the rectangular portion of the molding. The lower lip is shaped so as to make biased pressure contact with the countertop wherein all irregularities of the countertop are filled by the lower lip. The upper lip forms an acute angle with the rectangular section of the molding so that when the lower edge of the back-splash board is placed into pressure contact with the tape on the upper surface of the rectangular portion of the molding, the upper lip is also biased into pressure contact with the outside face of the back-splash board to fill all irregularities.

As an added aid in installation, the rectangular portion is extruded in ¾-inch widths so as to fit without cutting to the ¾-inch back-splash board generally used in such installations. However, to make this molding more easily adaptable to narrower widths, longitudinal serrations are provided in the bottom and/or top surface of the rectangular extrusion in a preferred embodiment wherein the molding can be affixed to ¼-inch, ½-inch, or ¾-inch thick back-splash boards. This is accomplished by cutting the molding along the serration which provides the desired width of the molding.

Although the subject molding was originally developed for use in sealing back-splash boards and countertops, it has many other applications, such as providing vertical joints for wall sections with the wall sections being either coplanar or formed at an angle.

It is therefore among the objects of the invention to provide cabinet, panel, and wall section molding which: is resiliently deformable; is joinable to panel sections by pressure-sensitive adhesive foam tape; is provided with sealing lips biasable into pressure contact with adjacent panel sections; is adaptable for both horizontal and vertical panel installation; eliminates the need for caulking between panels for appearance purposes; seals against water penetration between panels without the need for caulking; is more easily, more quickly and less expensively installed than sheet metal molding; is available in any length; is coilable for ease in storage, transportation, handling, and applying; and is available in designer colors.

The foregoing and other objects, features, and advantages of the invention will become apparent from the description set forth hereinafter when considered in conjunction with the accompanying drawings.

DETAILED DESCRIPTION OF THE PREFERRED EMBODIMENTS OF THE INVENTION

Figure 5:
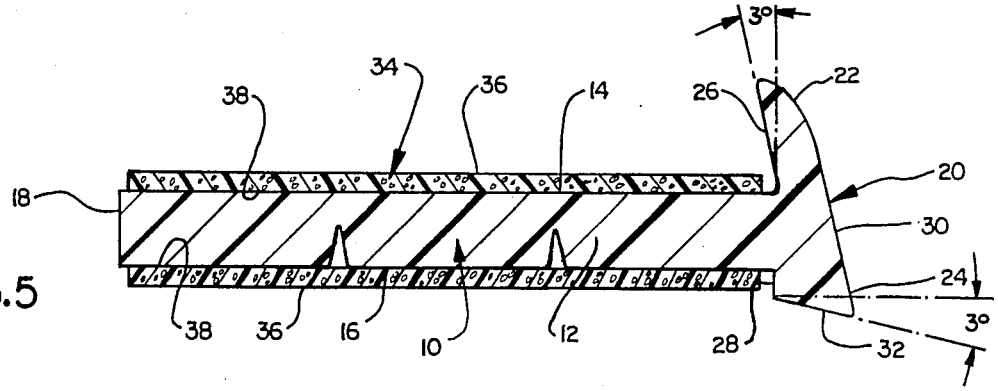
FIG. 5 is a cross-sectional elevation of a preferred embodiment of the invention.

The first preferred embodiment of the invention is made from extruded polyvinyl chloride testing to 75 durometer hardness. Referring to FIG. 5, the inventive extrusion 10 comprises a rectangular main body portion 12 having an upper surface 14, a lower surface 16, and an inside end surface 18. Integrally extruded with the rectangular main body portion 12 is a sealing cap 20 having an upper lip 22 and a lower lip 24. The inner face 26 of upper lip 22 forms a slightly acute angle with upper face 14. The inner face 28 of lower lip 24 forms a right angle with lower face 16 of rectangular body portion 12. Outer face 30 of lip 20 diverges from top to bottom to form a good contact surface 32 with a countertop or the like. Contact surface 32 is inclined so as to be biased against a counter top in pressure contact therewith.

Figure 1:
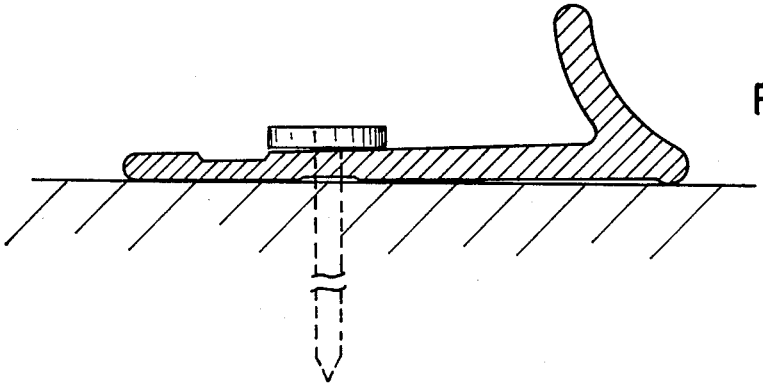
FIG. 1 PRIOR ART
FIG. 1 is an elevational view in section of one form of prior art sheet metal molding.
Figure 2:
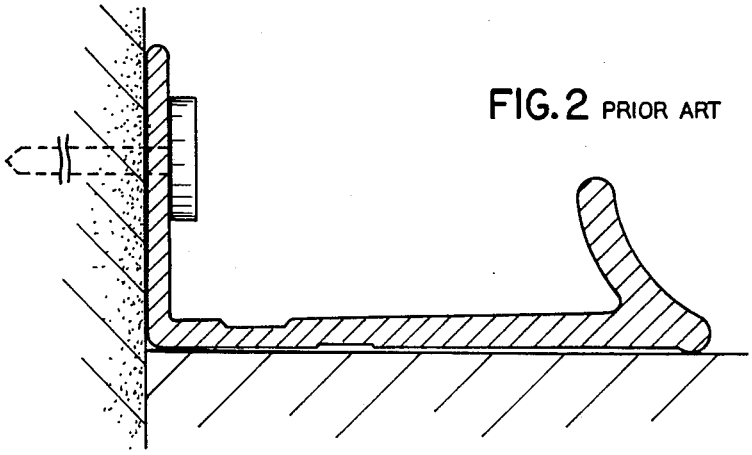
FIG. 2 PRIOR ART
FIG. 2 is an elevational view in section of another form of prior art sheet metal molding.
Figure 3:
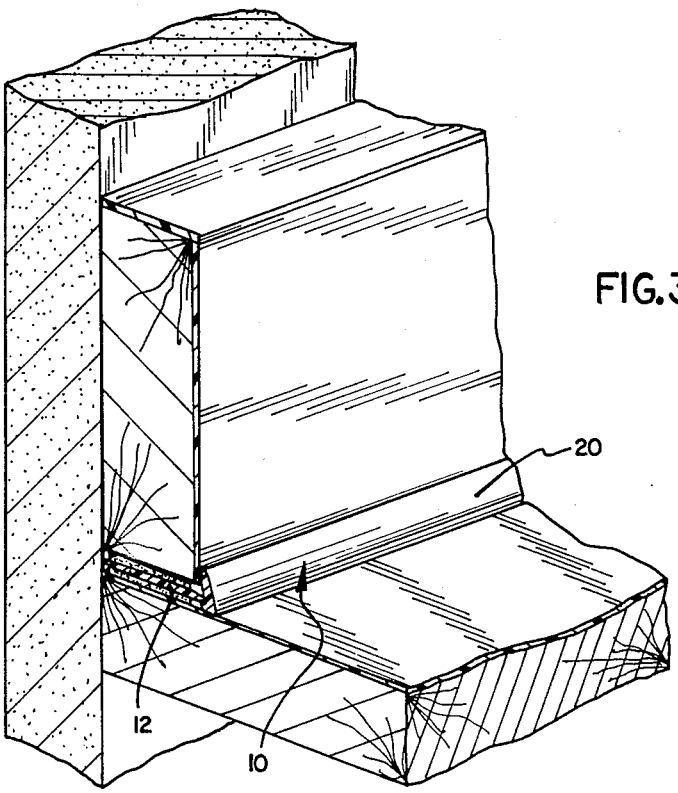
FIG. 3 is a perspective view of a preferred embodiment of the invention shown installed.
Figure 4:
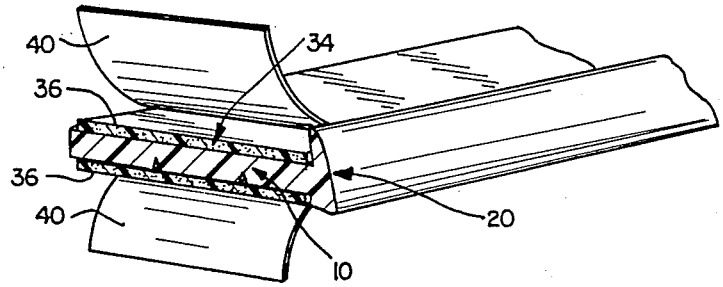
FIG. 4 is a perspective view of a preferred embodiment of the invention, in partial section, prior to installation.

Polystyrene foam tape 34, having both its upper and lower surface 36 and 38 impregnated with pressure-sensitive adhesive, is secured to both the upper and lower surfaces 14 and 16 of rectangular molding body portion 12. The upper surfaces 36 of foam tape 34 are protected against inadvertent contact prior to installation by protective layers of polyvinyl strips 40 (see FIG. 4).

Figure 6:
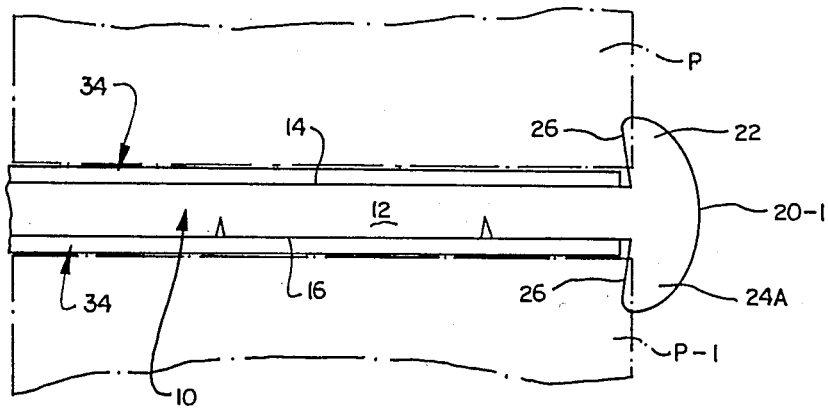
FIG. 6 is a second embodiment of the invention shown in elevation.
Figure 7:
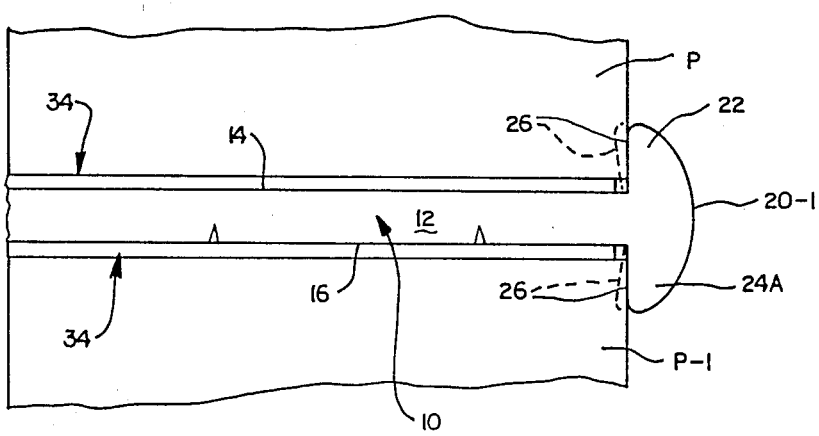
FIG. 7 is another view of the embodiment of the invention shown in FIG. 6.

Referring to FIG. 6, there is shown a molding adapted for sealing two abutting wall panels edge to edge. In this embodiment, the upper lip 22 is substantially the same configuration as the upper lip 22 shown in FIG. 5. Also, lower lip 24A is substantially the same configuration as the upper lip 22, wherein inner faces 26 of the upper and lower lips form acute angles with upper and lower surfaces 14 and 16 of rectangular body 12. Thus, when the end portions of panels are brought into contact with the pressure-sensitive tape 34, the lips 22 and 24A are biased clockwise and counterclockwise, respectively, away from the faces of the panels, thereby obtaining pressure engagement between the lips and the panels. The final relationship between upper lip 22 and lower lip 24A and abutting panels P and P-1 is illustrated in FIG. 7.

Figure 8:
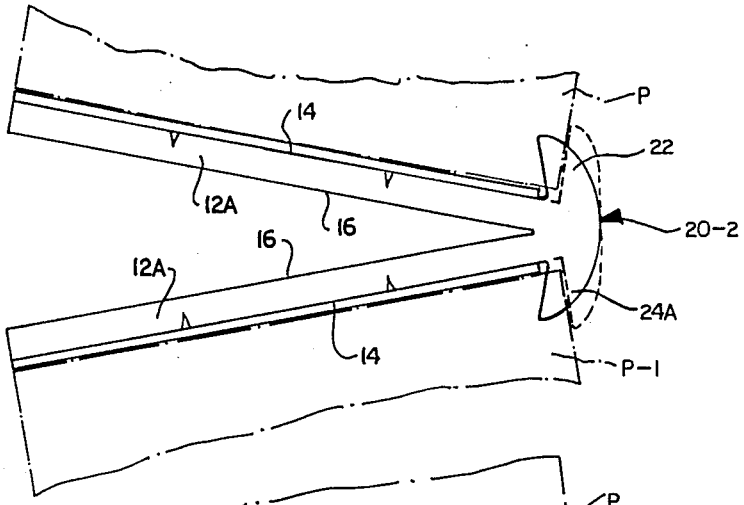
FIG. 8 is a third embodiment of the invention shown in elevation.

If the panel sections cannot be brought into abutting contact in coplanar alignment, the modification of the invention shown in FIG. 8 may be used. Therein shown, a pair of rectangular body members 12-A are provided, with the outer and inner surfaces 14 and 16 of each converging toward the cap 20-2 to compensate for misalignment between the panels or to compensate for panels intentionally abutting at an acute angle.

Figure 9:
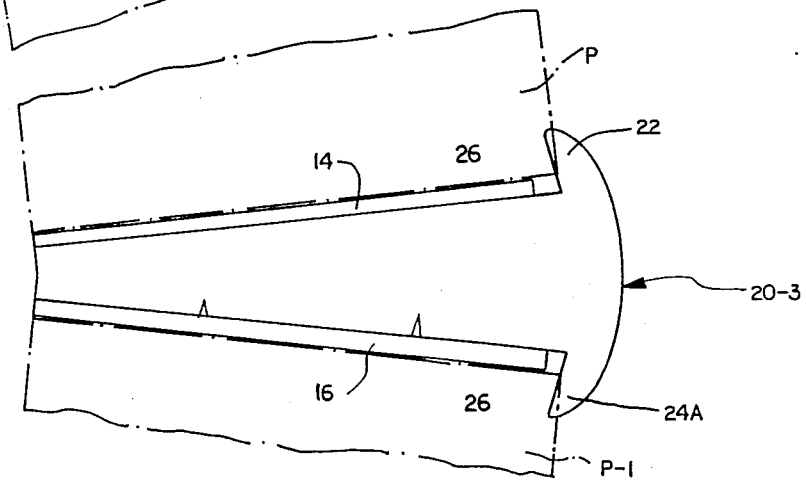
FIG. 9 is a fourth embodiment of the invention shown in elevation.

When the wall sections make abutting contact to form an obtuse angle, the embodiment of the molding shown in FIG. 9 can be used. As therein shown, the upper and lower surfaces 14 and 16 diverge toward the cap 20-3. Accordingly, it is necessary to have the inner faces 26 of cap 20 acutely inclined toward the upper and lower surfaces 14 and 16 to ensure pressure engagement between the lips 22 and 24A and the panel members P and P-1.

Figure 10:
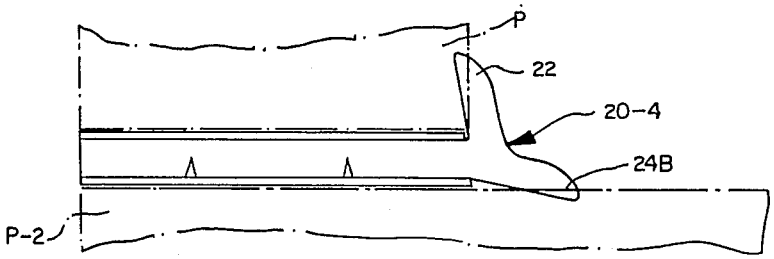
FIG. 10 is a fifth embodiment of the invention shown in elevation.

When the panels meet at right angles to form a severe interior angle, the embodiment of the invention shown in FIG. 10 may be used. Thus, the panels P and P-2 join to form an interior right angle which is sealed by cap 20-4 having lips 22 and 24B, both biased against their respective panels.

Figure 11:
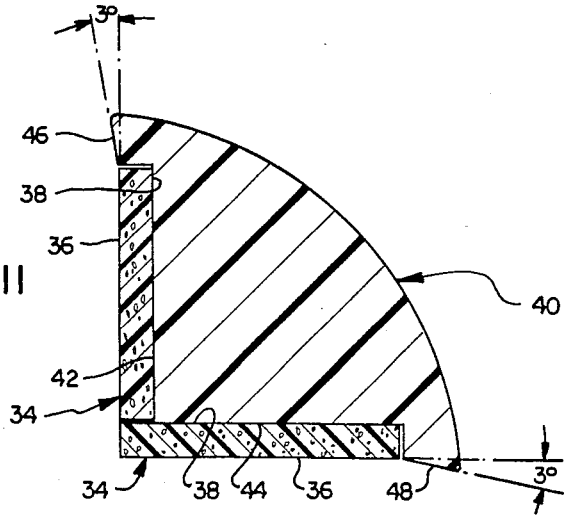
FIG. 11 is a sixth embodiment of the invention shown in cross-sectional elevation.

For the do-it yourself enthusiast, or for professional post installation molding and sealing, the embodiment of FIG. 11 has been developed. Herein shown is a quarter round molding strip 40 having rectangular recesses 42 and 44 to receive pressure-sensitive tape 34. An inclined lip 46 is provided to be biased into pressure contact with a splash board. In the like manner, inclined lip 48 is provided to be biased into pressure contact with a countertop. In all embodiments of the invention, a 3° inclination of the lips has proved to be very effective for both sealing and contour compensation. In application, the tape may be applied to the corner of the cabinet, as shown in FIG. 11. Thereafter molding 40 may be pressed into place. In the alternative, the tape may first be applied to the molding and then the molding may be pressed into place. In either event, molding 40 must be carefully positioned so as to bias lips 46 and 48 into pressure sealing contact with their respective panel surfaces.

Having now described the preferred embodiments of the invention, it will occur to those skilled in the art, upon reading the specification in conjunction with a study of the drawings, that certain modifications may be made to the described molding. However, it is intended that the invention only be limited by the scope of the appended claims.

What is claimed is:

1. A device for sealing and integrating a pair of panels in substantial right angle alignment one with the other wherein one panel is substantially vertical and the other panel is substantially horizontal to define an internal right angle, said device comprising: a deformable molding having an elongated portion substantially rectangular in cross section and adapted to engage the lower edge of said vertical panel and a top surface of said horizontal panel; said elongated portion of said deformable molding being sized to substantially approximate the width of the lower edge of said vertical panel; lip means secured to one edge of said elongated portion adapted to make pressure sealing contact against a surface of said vertical panel and against a surface of said horizontal panel, said vertical and horizontal surfaces forming an internal intersection of said panels, and first and second tape integrating means secured to opposite sides of said elongated portion and with pressure sensitive adhesive means adapted to integrate said pair of panels by bonding said elongated portion therebetween.

2. The device of claim 1 wherein said lip means has a first internal surface forming an acute angle with said elongated portion and a second internal surface forming an obtuse angle with said elongated portion, said surfaces being biasable to assume the angulation of their respective adjacent panel surfaces to form pressure sealing contact therewith.

3. The device of claim 2 wherein said acute angle is substantially 87 degrees and said obtuse angle is substantially 177 degrees.

4. The device of claim 2, wherein said first internal surface is adapted to contact a vertical panel surface and said second internal surface is adapted to contact an horizontal panel surface.

* * * * *